US006219519B1

(12) United States Patent
Garzolini et al.

(10) Patent No.: US 6,219,519 B1
(45) Date of Patent: Apr. 17, 2001

(54) REDUCED HOT OFFSET IN COLOR ELECTROPHOTOGRAPHIC IMAGING

(75) Inventors: Judith A. Garzolini, Boise; Kristina J. Wood, Eagle; Kenneth E. Heath, Boise, all of ID (US); Joseph C. Carls, Austin; Dennis D. Anderson, Leander, both of TX (US)

(73) Assignees: Hewlett-Packard Company, Palo Alto, CA (US); 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/695,818

(22) Filed: Oct. 24, 2000

Related U.S. Application Data

(63) Continuation of application No. 09/464,219, filed on Dec. 15, 1999.

(51) Int. Cl.[7] ..... G03G 15/01; G03G 15/20

(52) U.S. Cl. ..... 399/321; 399/324; 430/97

(58) Field of Search ..... 399/321, 324, 399/341, 342; 430/97, 124

(56) References Cited

U.S. PATENT DOCUMENTS 5,702,852 * 12/1997 May et al. ..... 430/47
5,875,381 * 2/1999 Moser ..... 399/324
6,042,979 * 3/2000 Ohishi et al. ..... 430/45

FOREIGN PATENT DOCUMENTS 5-150682 * 6/1993 (JP) .

* cited by examiner

*Primary Examiner*—Joan Pendegrass
(74) *Attorney, Agent, or Firm*—Lane R. Simmons

(57) ABSTRACT

Hot offset of black toner is reduced or eliminated in a color electrophotographic imaging device, such as a laser printer, by applying a minimal layer of non-black toner in addition to the black toner on a print media. The non-black toner, such as cyan, magenta or yellow toner, acts as a release agent for reducing or eliminating hot offset of the black toner during fusing of the toner to the media. The non-black toner is applied as a thin layer just sufficient to reduce hot offset of the black toner and such that an appearance of a resultant image formed retains a visual perception of being a black toner only image. In an alternate embodiment, the thin layer of non-black toner is applied in response to coated media being processed, such as overhead transparencies, that are more susceptible to hot offset. In yet a further alternate embodiment, raster source image data is converted to output data using a process neutral axis color rendering table, and vector source image data is converted to output data using the same process neutral axis color rendering table only if coated media is being processed, thereby reducing hot offset of black toner. Otherwise, the vector source image data is converted to output data using a black only neutral axis color rendering table.

19 Claims, 9 Drawing Sheets

REDUCED HOT OFFSET IN COLOR ELECTROPHOTOGRAPHIC IMAGING

CROSS REFERENCE TO RELATED APPLICATION(S)

This is a continuation of copending application Ser. No. 09/464,219 filed on Dec. 15, 1999.

FIELD OF THE INVENTION

This invention relates in general to color imaging systems and, more particularly, to reducing toner hot offset in color electrophotographic laser printers.

BACKGROUND OF THE INVENTION

Electrophotographic (EP) processes for producing a permanent image on media are well known and commonly used. In general, a common process includes: (1) charging a photoreceptor (optical photoconductor or OPC) such as a roller or continuous belt bearing a photoconductive material; (2) exposing the charged photoreceptor to imaging light (laser) that discharges the photoreceptor in select areas to define a latent electrostatic image on the photoreceptor; (3) presenting developer particles (toner) to the photoreceptor surface bearing the image so that the particles are transferred to the surface in the shape of the image; (4) transferring the particles in the shape of the image from the photoreceptor to the media; (5) fusing or fixing the particles in the shape of the image to the media; and (6) cleaning or restoring the photoreceptor for the next printing cycle. Many image forming apparatus, such as laser printers, copy machines, and facsimile machines, utilize this well known electrophotographic printing process.

Laser driven color printers and copiers employ toners that enable light to reflect off the page and to be directed back towards the eye. In general, such devices employ cyan (C), magenta (M) and yellow (Y) toners as the principal component colors, from which other colors are created. Light passing through CMY toners has part of its color filtered out or absorbed by the toner such that the reflected light takes on the color of the toners that it passes through. In laser printers (and some copiers), a black (K) toner is also used which is opaque to light. When a printer receives image data from a host processor, the data is received in the form of either Red, Green and Blue (RGB) values, CMYK values, L*a*b* or some other conventional color space values. In any case, the received values are typically converted to CMYK values in order to achieve desired levels of color representation on the final imaged document.

Many color EP devices, such as color laser printers, utilize a four-pass process to produce a full-color CMYK image on a photoconductor. For example, FIG. 1 is a block diagram depicting a conventional EP system wherein four developer modules 1,2, 3 and 4 are arranged along a moving photoconductor surface/drum 5. Each developer module is allocated to the deposition of one of the CMY and K toners onto the moving photoconductor 5. A charging station (corona) 6 uniformly charges the photoconductor 5 and an exposure station (laser light) 7 selectively discharges the photoconductor in accordance with a color plane's image data. The imaged photoconductor 5 then moves past the respective developer modules, with one developer module being moved into juxtaposition with the photoconductor (such as is shown with black developer 4) to allow color toning of the discharged areas. The developed photoconductor then experiences a full rotation, is charged again 6, and then exposed again in accordance with a next color plane's data and again developed, using the next color developer. The procedure continues until four passes have occurred and a full color image is present on the photoconductor 5. Thereafter, the image is electrostatically transferred via a transfer roller 9 to a sheet media 11 and subsequently fused to the sheet media 11 by fuser roller 12.

Alternatively, after development of any given color plane, that color plane's image on the photoconductor surface may be transferred to an intermediate transfer (IT) member (not shown) prior to ultimately being transferred to the sheet media. Once all color planes are transferred to the IT member, only then is the entire, full color image transferred to the media. This is commonly known as indirect transfer. To clarify, for example, upon each revolution of the photoconductor, one color plane will be imaged on the photoconductor and then immediately transferred to the IT member before a next color plane is similarly imaged and the process repeated. Once the IT member holds all of the color planes forming the final color image, the image is then transferred to the sheet media. In such indirect transfer, the IT member is generally large enough to hold an entire image plane at one time. Whether direct or indirect electrostatic image transfer occurs, the resultant image of toner is subsequently fused to the sheet media.

In EP systems, "hot offset" occurs when the fuser 12 picks up toner from a sheet 11 currently being fused and, depending upon fuser roller size and sheet size, transfers that picked up toner to a trailing portion 13 of the sheet or to a next sheet fused (not shown). The hot offset transfer is typically noticed as a "shadow" of the source image originally fused. Hot offset tends to occur more with certain black toners than with other non-black color toners such as cyan, magenta or yellow. Additionally, hot offset tends to occur and tends to be more noticeable when extremely smooth, less absorbing, or coated media are imaged, such as overhead transparencies (OHTs), partially because these media characteristics or coatings act as a smooth barrier that disallows the toner from absorbing more completely into the media. For ease of discussion purposes, any media that have characteristics of an extremely smooth surface, or are generally less absorbing, or are coated to achieve such a surface condition (all relative to conventional paper media typically used in printers and copies), will be referred to herein as "coated" media.

FIG. 2 depicts an example of a conventional black text image 14 fused onto a coated sheet media 11, and further depicts a hot offset "shadow" occurrence 15 of the original text image 14 disposed near the trailing edge of the sheet. The black text image 14 is fused onto the sheet 11 by the fuser 12 but, undesirably, some of the toner particles from the image 14 are retained on the fuser. Consequently, as the trailing end 13 of the sheet 11 passes through the fuser 12, the shadow image 15 is formed.

Accordingly, an object of the present invention is to reduce or eliminate hot offset in a color imaging device.

SUMMARY OF THE INVENTION

According to principles of the present invention in a preferred embodiment, hot offset of black toner is reduced or eliminated in a color electrophotographic imaging device, such as a laser printer, by applying a minimal layer of non-black toner in addition to the black toner on a print media. The non-black toner, such as cyan, magenta or yellow toner, acts as a release agent for reducing or eliminating hot offset of the black toner during fusing of the toner to the media. The non-black toner is applied as a thin layer just sufficient to reduce hot offset of the black toner and such that an appearance of a resultant image formed retains a visual perception of being a black toner only image. In an alternate embodiment, the thin layer of non-black toner is applied in response to coated media being processed, such as overhead transparencies, that are more susceptible to hot offset.

In yet a further alternate embodiment, raster source image data is converted to output data using a process neutral axis color rendering table, and vector source image data is converted to output data using the same process neutral axis color rendering table only if coated media is being processed, thereby reducing hot offset of black toner. Otherwise, the vector source image data is converted to output data using a black only neutral axis color rendering table.

According to further principles, an electrophotographic imaging device embodies apparatus, procedures and data for enabling the methods of the present invention.

Other objects, advantages, and capabilities of the present invention will become more apparent as the description proceeds.

DETAILED DESCRIPTION OF THE INVENTION

Figure 1:
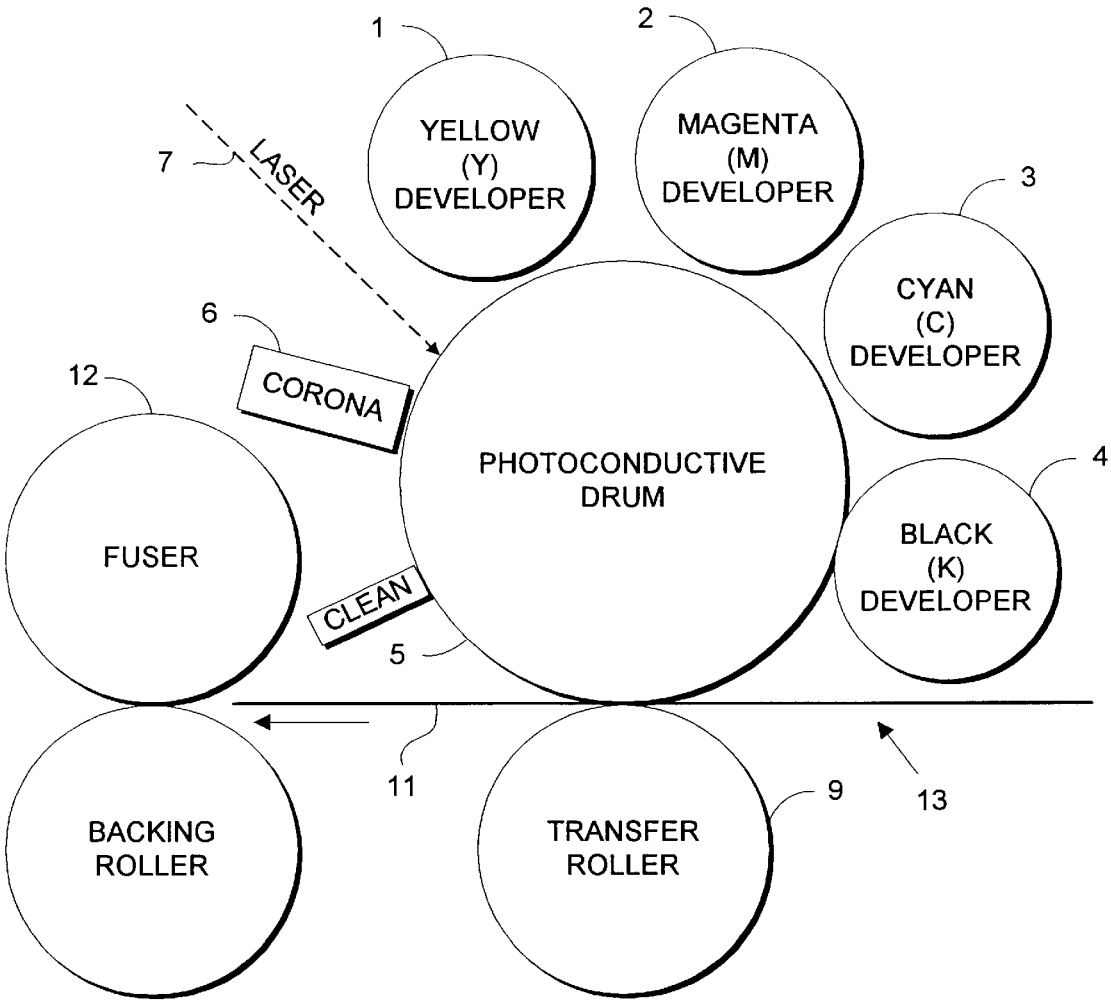
FIG. 1 (PRIOR ART)
FIG. 1 is a block diagram depicting a conventional EP color imaging system having four developer modules arranged along a photoconductor drum.
Figure 2:
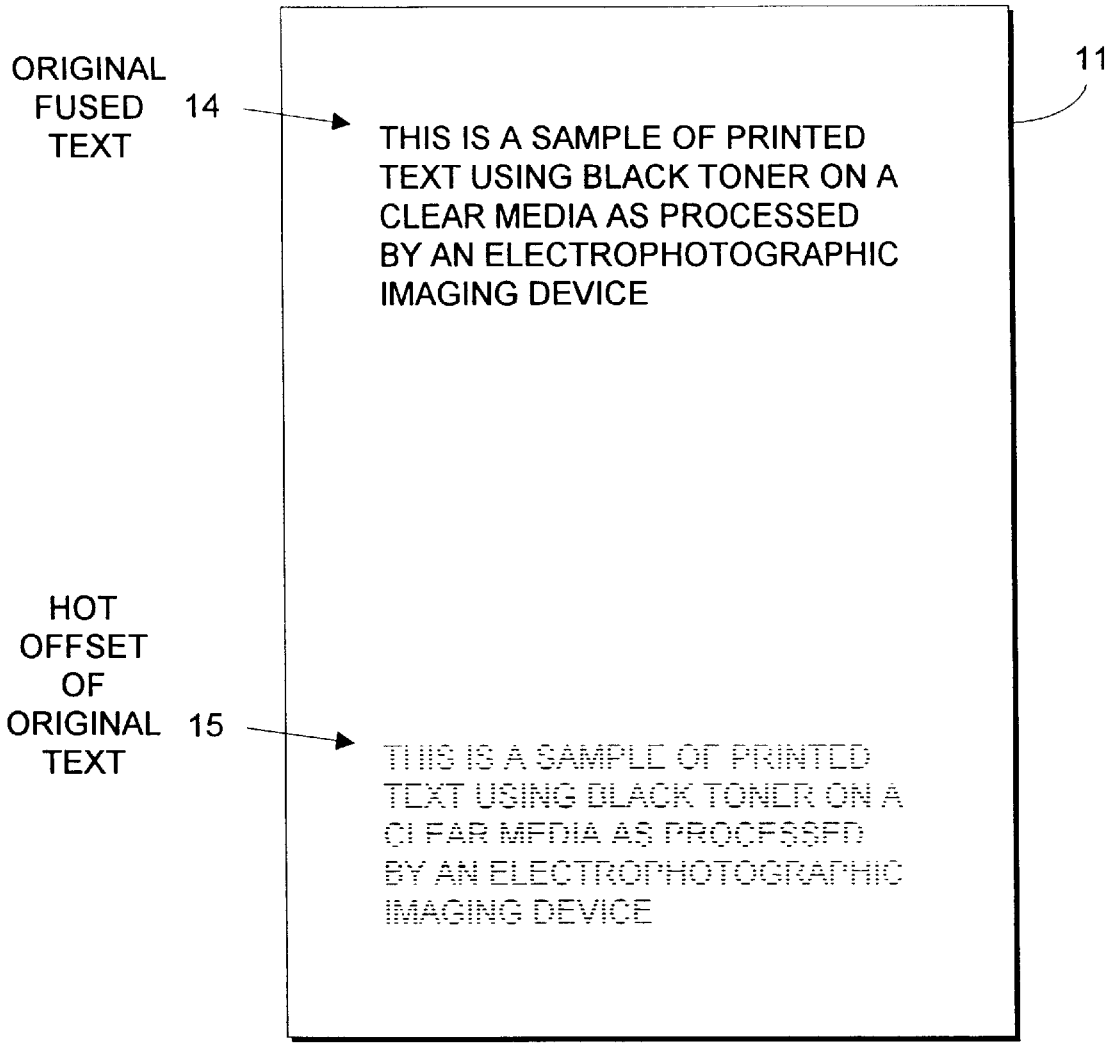
FIG. 2 (PRIOR ART)
FIG. 2 is a block diagram of a conventional sheet of media having an image developed thereon and a hot offset shadow occurrence of the image.
Figure 3:
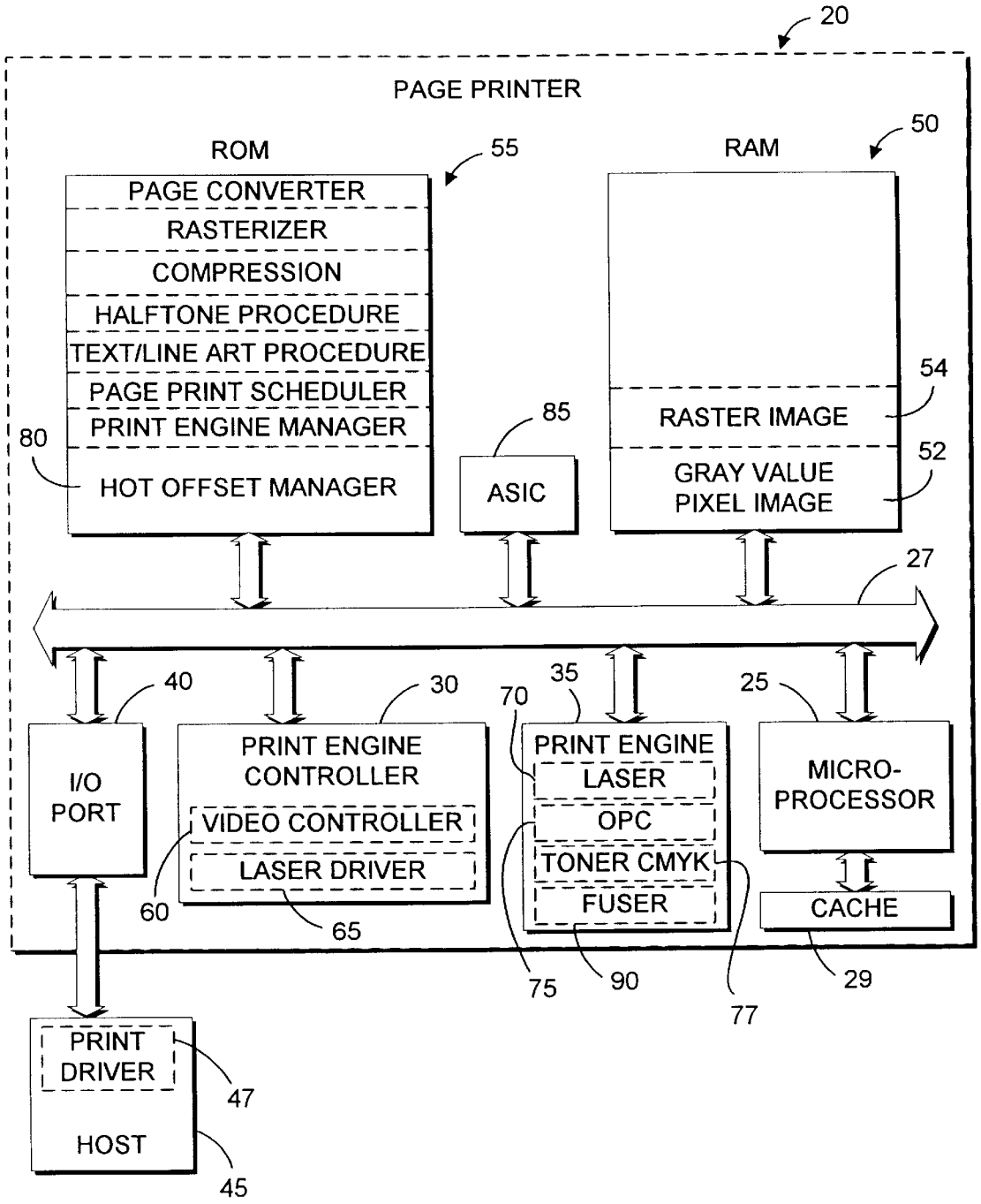
FIG. 3 is a block diagram of a laser printer incorporating the present invention apparatus and method for reducing or eliminating toner hot offset.

FIG. 3 is a high level block diagram of a color page printer 20 incorporating the present invention apparatus and method for reducing hot offset of an image. The page printer 20 is controlled by a microprocessor 25 which communicates with other elements of the system via a bus 27. The microprocessor 25 includes a cache memory 29 in a preferred embodiment. A print engine controller 30 and associated print engine 35 connect to the bus 27 and provide the print output capability for the page printer. For purposes of this disclosure, the print engine 35 is a color laser printer that employs an electrophotographic drum and imaging system as well known in the art. However, as will be obvious to those of ordinary skill in the art, the present invention is similarly applicable to other types of color printers and/or imaging devices including, for example, facsimile devices, copiers, or the like. Like components between figures are labeled with like reference numbers.

An input/output (I/O) port 40 enables communications between the page printer 20 and a host computer 45 and receives page descriptions (or raster data) from the host for processing within the page printer. The host 45 includes a stored executable routine (a print driver) 47, for controlling communication with printer 20 and enabling printing. A dynamic random access memory (RAM) 50 provides a main memory for the page printer 20 for storing and processing a print job data stream received from the host 45. A read only memory (ROM) 55 holds firmware that controls the operation of the microprocessor 25 and page printer 20. It is understood, however, that functional procedures discussed herein for the printer 20 may be maintained and utilized as control firmware in any conventional ROM, and/or implemented in an application specific integrated circuit (ASIC) 85 for high-speed hardware functionality, and/or implemented in connection with RAM 50 or cache 29 for storage and buffering purposes as conventional in the art.

Code procedures stored in the ROM 55 include, for example, a page converter, rasterizer, compression code, halftone procedure, text/line art procedure, page print scheduler, print engine manager, and/or other image processing procedures (not shown) for generating a color image from a print job data stream. As conventional in the art, the page converter firmware converts a page description received from the host to a display command list, with each display command defining an object to be printed on the page. The rasterizer firmware converts each display command to an appropriate bit map (rasterized strip or band) and distributes the bit map into memory 50. The compression firmware compresses the rasterized strips in the event insufficient memory exists in the RAM 50 for holding the rasterized strips. The objective of the halftone procedure is to convert any continuous tone image into a halftoned raster image. The text/line art procedure also converts any text and line art images into a raster image. These may be conventional procedures known in the art and are often referred to as the image processing pipeline for rendering image data for output on the print engine 35.

Importantly, the ROM 55 further includes a hot offset manager 80 according to principles of the present invention. The hot offset manager 80 includes routines, tables (such as color rendering dictionaries/tables) and/or other data structures as necessary for controlling the printer 20 and reducing hot offset of toner as will be discussed more fully herein. Although in FIG. 3 the hot offset manager 80 is depicted in connection with the ROM 55, it will be obvious and understood by those of ordinary skill in the art that the same may be implemented in a ROM 55, an ASIC 85, or a RAM 50, or any combination of these.

The RAM 50 is shown as storing a gray value pixel image 52 which is to be altered into a source raster image 54 suitable for rendering by the laser print engine 35. The gray value pixel image 52 is received from the host 45 via the I/O port 40. The raster image 54 may be buffered in RAM or fed directly from the ASIC 85 to the print engine controller 30 and print engine 35. The gray value pixel image 52 is of the known type, for example, wherein each pixel is represented by a multi-bit gray value. In a preferred embodiment, the gray value pixel image 52 is a color image, comprising four color planes with three of the color planes representing cyan (C), magenta (M) and yellow (Y) color values. Each color value in each CMY color plane is represented by a predetermined number of bits—for example, by 8 bits. The fourth plane, representing black (K), may be comprised of single or multiple bit values at each pixel location where a black or gray scale image value is to appear on the ultimate rendered output. Thus there may be a total of 25 to 32 bits per pixel in the gray value pixel image 52 where color is embodied. On the other hand, if the gray value pixel image 52 is a non-color image, each pixel may, for example, be represented simply by 8 bits to depict 256 levels of gray as well known in the art. Other bit depths and color planes are equally applicable in the present invention, as will be obvious to those of ordinary skill in the art.

In general, the operation of the page printer 20 commences when it receives a page description from the host computer 45 via the I/O port 40 in the form of a print job data stream. The page description is placed in RAM 50 and/or cache 29. The microprocessor 30 accesses the page description, line by line, and builds a display command list using the page converter firmware in ROM 55. As the display command list is being produced, the display commands are sorted by location on the page and allocated to page strips in memory 50. When all page strips have been evaluated, rasterized, and/or compressed, etc. for processing by the print engine 35, the page is closed and the rasterized strips are passed to the print engine 35 by the print engine controller 30, thereby enabling the generation of an image (i.e., text/graphics etc). The page print scheduler in ROM 55 controls the sequencing and transferring of page strips to the print engine controller 30. The print engine manager controls the operation of the print engine controller 30 and, in turn, the print engine 35.

The processor 25 feeds to a video controller 60 the raster image 54 of binary values which represent the image to be imprinted on a page. The video controller, in response, feeds a series of binary data signals to a laser driver 65 which, in turn, modulates a laser 70 in accordance with the binary data signals. As conventional in the art, the modulated beam from the laser 70 is directed at a rotating, faceted mirror that scans the beam across an imaging lens which directs the scanned beam to a mirror which redirects the scanned beam onto a moving OPC 75. The laser beam is scanned across the OPC to cause selective discharge thereof in accordance with the modulation of the beam. At the termination of each scan action, the laser beam is incident on a photodetector which outputs a beam detect signal that is used to synchronize the actions of the video controller 60 and processor 25. Subsequent to the selective discharge of the OPC 75 pursuant to a given color plane image, the respective color plane toner 77 (i.e., C, M, Y or K) is applied onto the discharged pixel locations to form a visible image on the OPC. Once all color planes are appropriately applied (or not applied), the visible image on the OPC is then transferred to a print media such as a sheet of paper (not shown) that is passed through the printer 20, and then the image is fused to the media by the fuser 90.

Further to the operation of the printer 20 and according to principles of the present invention, the hot offset manager 80 enables the printer 20 to reduce hot offset of toner 77 on a sheet media at the fuser 90 by modifying the toner sequence lay down process. Specifically, because the occurrence of hot offset tends to occur more with black toner than with the C, M or Y color toners, the present invention reduces black toner hot offset by additionally applying a "thin" layer of non-black color toner, such as C, M or Y, to all areas of an image (i.e., in a template match) that are designated as true black (i.e., designated as a K only color plane). Importantly, the thin layer of color toner acts as a release agent to prevent or reduce the black image from adhering to the fuser 90. As a result, black toner hot offset is reduced or eliminated.

In a preferred embodiment, yellow (Y) toner is applied as the thin layer to act as the release agent for the black (K) only image. However, other non-black toner colors are similarly feasible. Also preferably, the thin color layer is applied such that it overlays the black layer in a template match and so that the color layer contacts the fuser 90 to act as the release agent rather than the black layer directly contacting the fuser. Alternatively, depending upon the imaging and fusing system implementation, the layering of the black toner and non-black toner is not order specific, so long as both are applied to the media. In any case, no other special release agent needs to be embodied in the printer. Rather, the color toner that is already available serves as a release agent. Also in a preferred embodiment, the thin layer of non-black toner is applied at about between five percent (5%) and fifty percent (50%) of the amount of black toner application. Additionally in an alternate embodiment, the thin layer of non-black toner is applied in response to coated media being processed in the imaging device 20, such as an overhead transparency.

Although it is conventional in the art to produce a "process black" color by combining equal amounts (theoretically) of the C, M, Y color toners, and/or by combining one or more of the C, M, Y color toners with the K toner, the resultant process black does not necessarily appear the same as a true black that is developed with a K only toner. For example, it is known to produce a process black having CMYK data values of CMYK=0,255,0,255, or alternatively, CMYK=15,15,15,255. However, each of these process black data values results in an image that appears darker or richer in color than a black image that is formed from a black only data value of CMYK=0,0,0,255. Thus, although a process black may tend to reduce hot offset because of the presence of the color toners, a process black visual color is not always desired. Printed text is an example of where a K only black image or data value is generally preferred. Additionally, using K only eliminates any color plane registration issues that exist in developing process black or other composite colors.

To this regard, the present invention hot offset manager 80 does not provide a "process black" color but maintains more of a true black (K only) color during imaging by only "thinly" layering one or more separate non-black C, M or Y color toners with the K toner, just sufficient to reduce or eliminate the potential for hot offset during fusing and without significantly altering the appearance of a desired K only black image. In other words, an appearance of a resultant image formed retains a visual perception of a black only image and not that of a process black color. In an alternate embodiment, the judicious redirection of source image data between a black only neutral axis color rendering table and a process neutral axis color rendering table enables the reduction or elimination of black toner hot offset.

Figure 4:
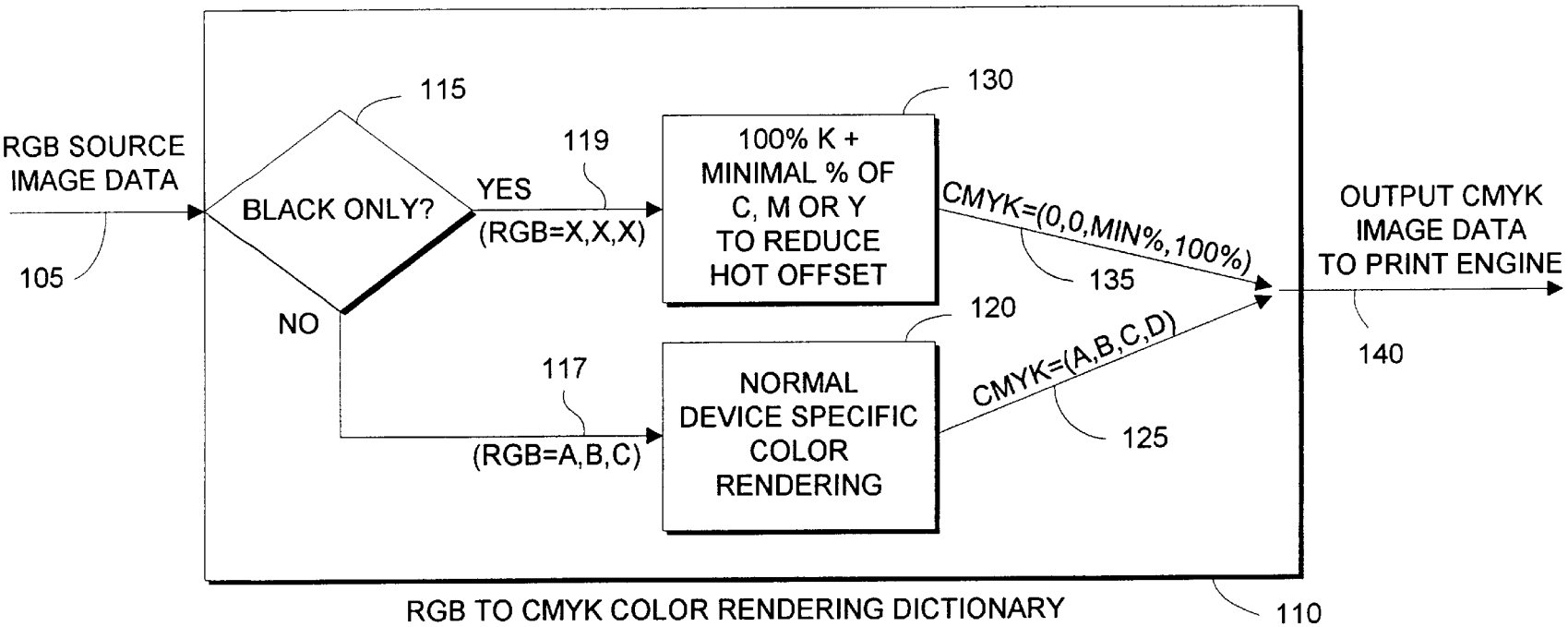
FIG. 4 is a block diagram depicting image data flow and color table configurations.

FIG. 4 is a block diagram of an exemplary RGB to CMYK color rendering dictionary (color table) 110 configuration and flow of image data in the printer 20 for enabling reduced hot offset under principles of the present invention in a preferred embodiment. FIG. 4 assumes RGB values are received as the defining input source data 105. For simplicity of discussion and depiction in the drawing, the RGB values are converted directly to CMYK values in the color table 110. However, it is understood that the RGB values 105 may be converted to some other device independent color space values as is known in the art before being input to the present invention color table and, as such, the color table would be adjusted respectively to receive those device independent color space values and to produce the proper output CMYK values.

Accordingly, as RGB source image data 105 is processed in printer 20, if the RGB source data values 105 are indicative of non black data 115, 117, then the data is processed using a conventional device specific color conversion 120 to produce resulting image data values 125 that are passed 140 to the print engine for toner application and image generation. The normal device specific color rendering conversion 120 may be selected from one of many known in the art. On the other hand, if the RGB source data values 105 are indicative of black only data 115, 119, then the data is processed using a color conversion 130 according to the present invention to produce resulting image data values 135 that are passed 140 to the print engine for toner application and image generation.

Importantly, under the present invention, the black only conversion 115, 119, 130, 135 clearly depicts that for any black only input image data 119 (i.e., RGB=0,0,0), the resultant CMYK output data includes not only a K value, but also an additional minimal non-black data value, such as a yellow (Y) data value, that acts as a release agent control indicia (i.e., CMYK=0,0,min %,100%). Note, however, that the non-black data value is minimal relative to the black value in order to retain a visual perception of a black only resultant image. For example, in a preferred embodiment, a non-black data value produced by the black only conversion table is generally between about five percent (5%) and fifty percent (50%) of the black data value, depending upon printer 20 system configurations and specifics. It should also be noted here that, although not shown, black only conversion 130 may be designed to output multiple non-black data values to act as the release agent data. For example, a five percent (5%) magenta (M) data value and a five percent (5%) yellow (Y) data value (for a MY combination total of 10%) may be output in addition to the 100% black (K) data value (i.e., CMYK=0,5%,5%,100%). In any case, preferably, no more than between about five percent (5%) to about fifty percent (50%) total non-black toner or combination of non-black toners is applied.

Although FIG. 4 depicts one example of 100% black data values (i.e., RGB=0,0,0), other less black (i.e., gray scale) values are clearly contemplated under the present invention and are included in the definition of "black data values" for purposes of this disclosure. For example, if the RGB input data values are indicative of a less pure black and more of a gray color (i.e., RGB=10,10,10), then the same is detected 115 (for example, by the RGB data values being equal to each other) and the output of conversion 130 is respectively more to the effect of 90% K toner value with, again, a minimal percent of a non-black toner (for example, CMYK= 0,0,9%,90%). However, as the source image data 105 becomes more gray, then the potential for black toner offset is typically reduced. Thus, at a given gray value threshold, determined by system design criteria and testing specific for any given imaging system, data conversion 130 is not needed. Rather, normal conversion 120 suffices because of the reduced potential for hot offset due to the reduced amount of black (K) toner designated. Accordingly, in a preferred embodiment, detection point 115 is set at a threshold value, for example, 70% gray scale black, for directing color conversion 130 to be used.

Figure 5:
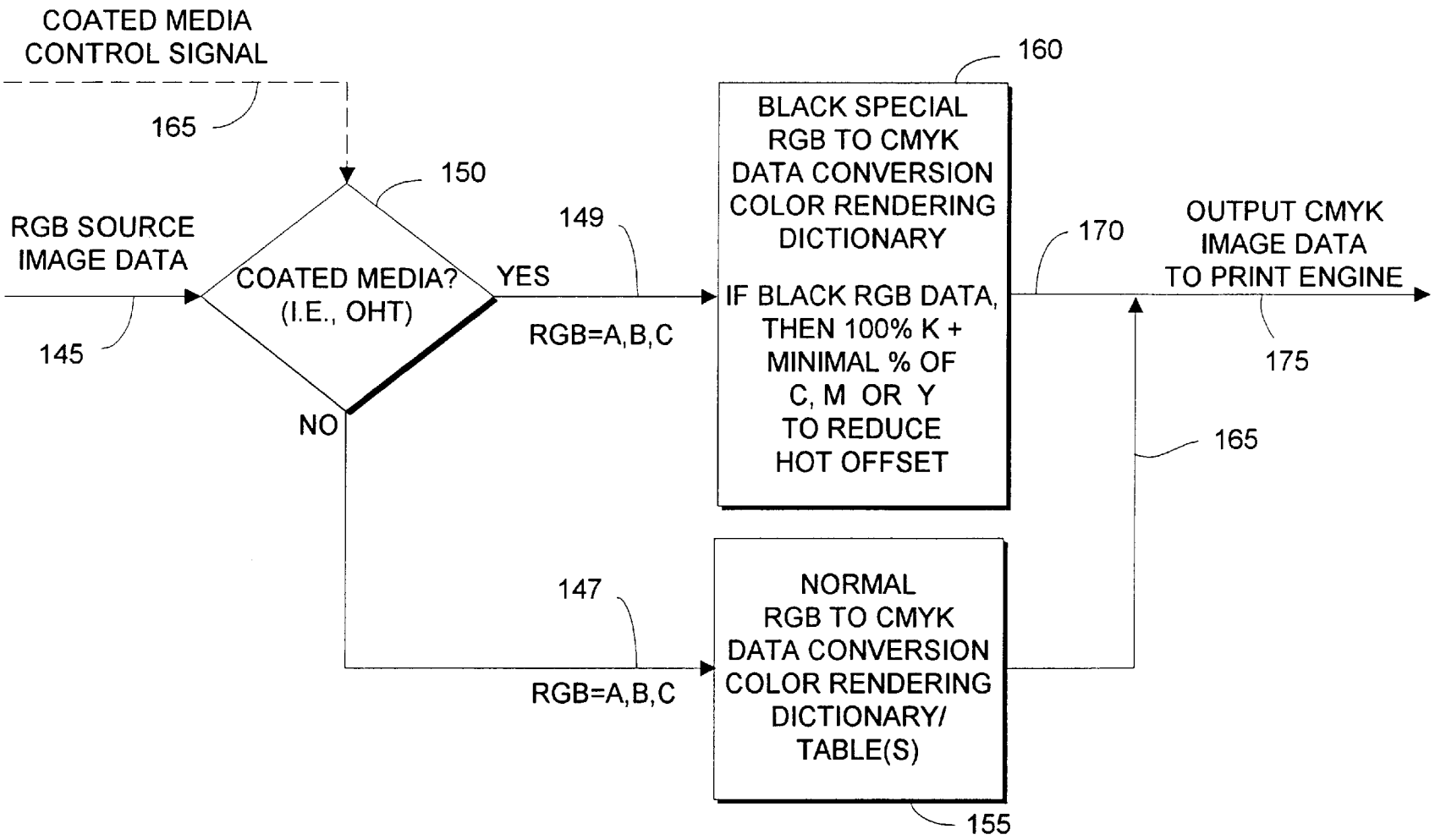
FIG. 5 is a block diagram depicting an alternate embodiment of image data flow and color table configurations.

FIG. 5 is a block diagram of an alternate embodiment of the present invention for reducing hot offset, including exemplary RGB to CMYK color rendering dictionary configurations and flow of image data in the printer 20 for enabling reduced hot offset. Again, FIG. 5 assumes RGB values are received as the defining input data 145 and, for simplicity of discussion and depiction in the drawing, the RGB values are converted directly to CMYK values in the depicted color tables.

FIG. 5 depicts the routing 150 of RGB source image data 145 to a specific RGB to CMYK rendering dictionary (color table) 155, 160, the routing being dependent upon a control signal 165 received from the host 45 (FIG. 3). The control signal 165 is generated from the printer driver routine 47 executing on the host. The control signal is enabled by user selection through the print driver interface on the host when a coated media, such as an overhead transparency (OHT), is to be image processed or is being image processed. Alternatively, the control signal 165 is generated by printer 20 itself when coated media is detected in the printer, for example, by mechanical or optical operation known in the art. In either case, as RGB source image data 145 is processed in printer 20, if control signal 165 indicates a coated media is not being image processed, then the data 145, 147 is processed using a conventional device specific color rendering dictionary 155 to produce resulting image data values 165 that are passed 175 to the print engine for toner application and image generation. The normal device specific color rendering conversion scheme (or table) 155 may be selected from one or more of many known in the art. A conventional dictionary 155 is feasible here because non-coated media typically do not have the toner hot offset problem that coated media have. Thus, for example, any black only neutral axis dictionary, process neutral axis dictionary, or combination of these dictionaries as known in the art may be used.

On the other hand, if control signal 165 indicates coated media (such as an OHT) will be or is being image processed, then the data 145, 149 is processed using a black special color rendering dictionary 160 according to the present invention to produce resulting image data values 170 that are passed 175 to the print engine for toner application and image generation. Importantly, for any source RGB black only image data values input to black special dictionary 160, the resultant output data values 170 include a respective K value in addition to a minimal non-black (i.e., C, M, Y or any combination) value as previously discussed to reduce the potential for hot offset while maintaining the visual appearance of a black only image. For example, again, CMYK= 0,0,min %,100%, where the non-black data value (Y) is between about five percent (5%) and fifty percent (50%) of the black data value.

Figure 6:
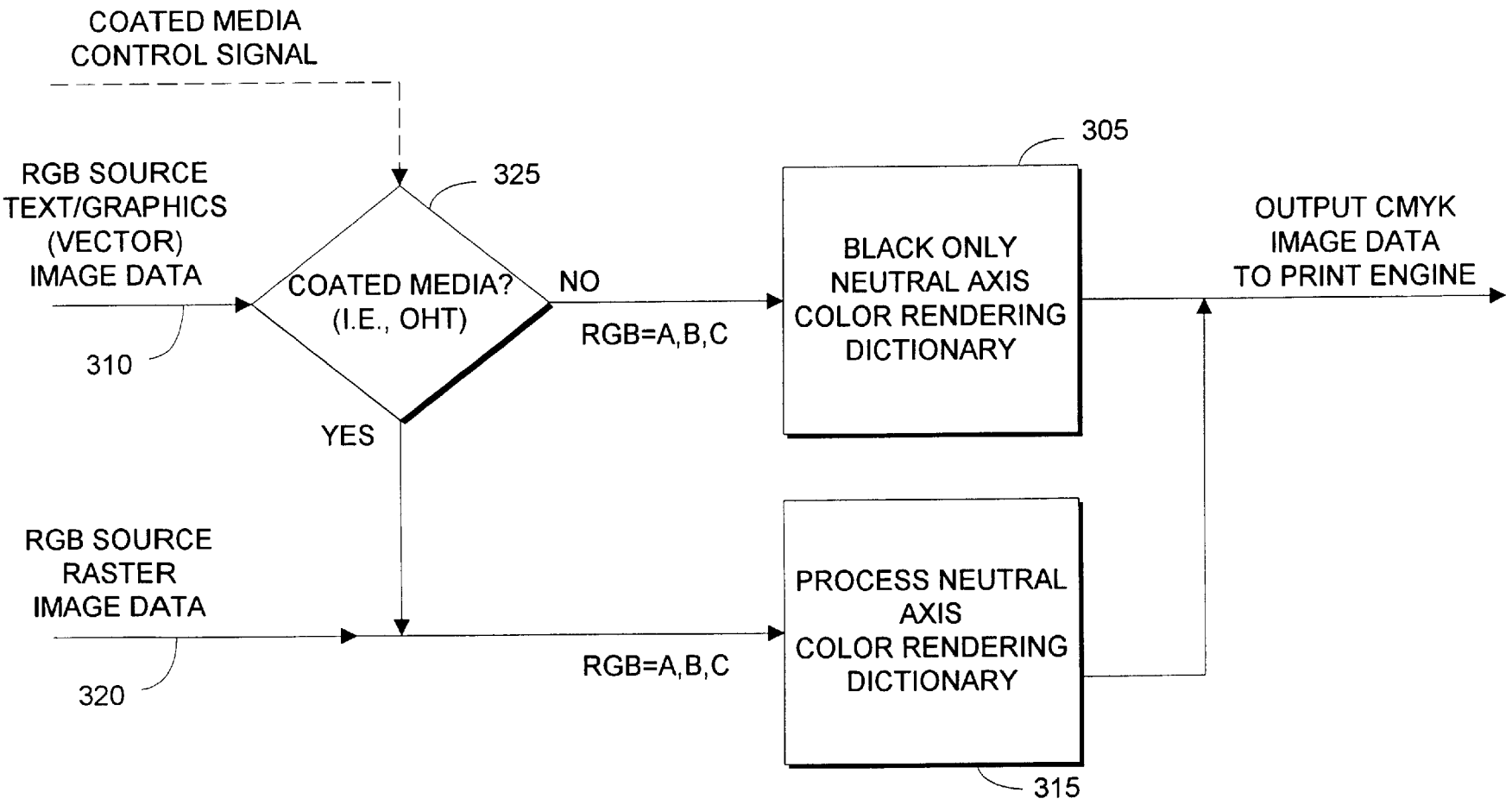
FIG. 6 is a block diagram depicting a further alternate embodiment of image data flow and color table configurations.

FIG. 6 depicts yet a further alternate embodiment of the present invention wherein a first color table (rendering dictionary) 305 is utilized primarily for vector data 310, such as text and graphics, and a second color table (rendering dictionary) 315 is utilized primarily for raster data 320. The distinction between vector and raster data is made upstream in the image processing pipeline as conventional in the art. The first color table 305 is a black only neutral axis color table because the black only neutral axis data conversion provides an improved black only printed image that is typically desired in text and vector graphics. On the other hand, the second color table 315 is a process neutral axis color table because the process neutral axis data conversion provides a deeper or richer black color (because of the combination of one or more of the other toners C, M, Y with the K toner) that is typically desired in raster images, such as photographs or continuous tone images. Both of the tables 305 and 315 are conventional tables known in the art.

Importantly, however, under the present invention, if coated media is detected 325, then any text/graphics (vector)

source data 310 is redirected 325 to be processed through the process neutral axis table 315. This ensures that any vector data, which typically includes black only data such as for text, is not rendered using the black only neutral axis table 305 but, rather, is rendered using the process neutral axis table 315. As such, potential hot offset of the black toner for any black only image is avoided. Although the process neutral table 315 may render process black images that are not necessarily desired for vector data, this is a recognized trade off for avoiding the hot offset problem.

Figure 7:
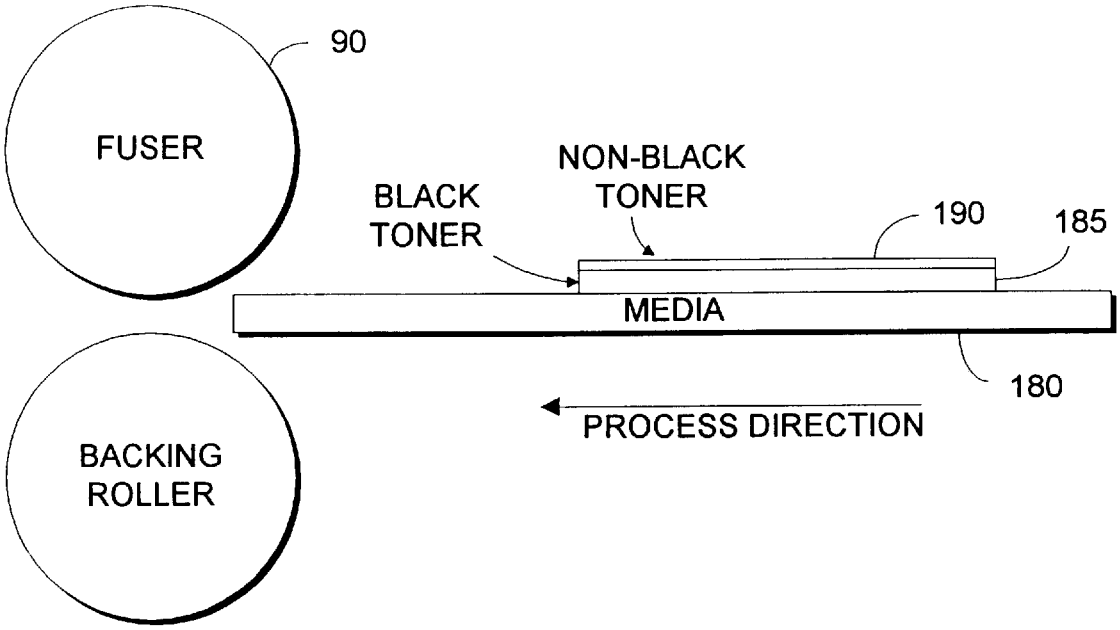
FIG. 7 is a block diagram of a sheet medium having black toner imaged thereon and a non-black toner deposited over the black toner to act as a release agent for fusing.

FIG. 7 is a block diagram depicting a medium 180 having a black only image formed thereon with a layer of black toner 185. According to the present invention, a minimal layer of a release agent 190, such as a non-black toner, is applied in addition to the black toner layer 185. Although not drawn to scale in the depicted example, the non-black toner is a layer applied at between about five percent (5%) and fifty percent (50%) of the black toner amount in a preferred embodiment. Importantly, though, the non-black toner layer 190 is applied in an amount just sufficient to reduce hot offset of the black toner onto the fuser 90 during fusing and such that an appearance of a resultant image formed retains a visual perception of a black (K) only image. Typically, the precise amount of non-black toner(s) depends on the operating parameters and configurations of the given imaging system and its fuser.

Figure 8:
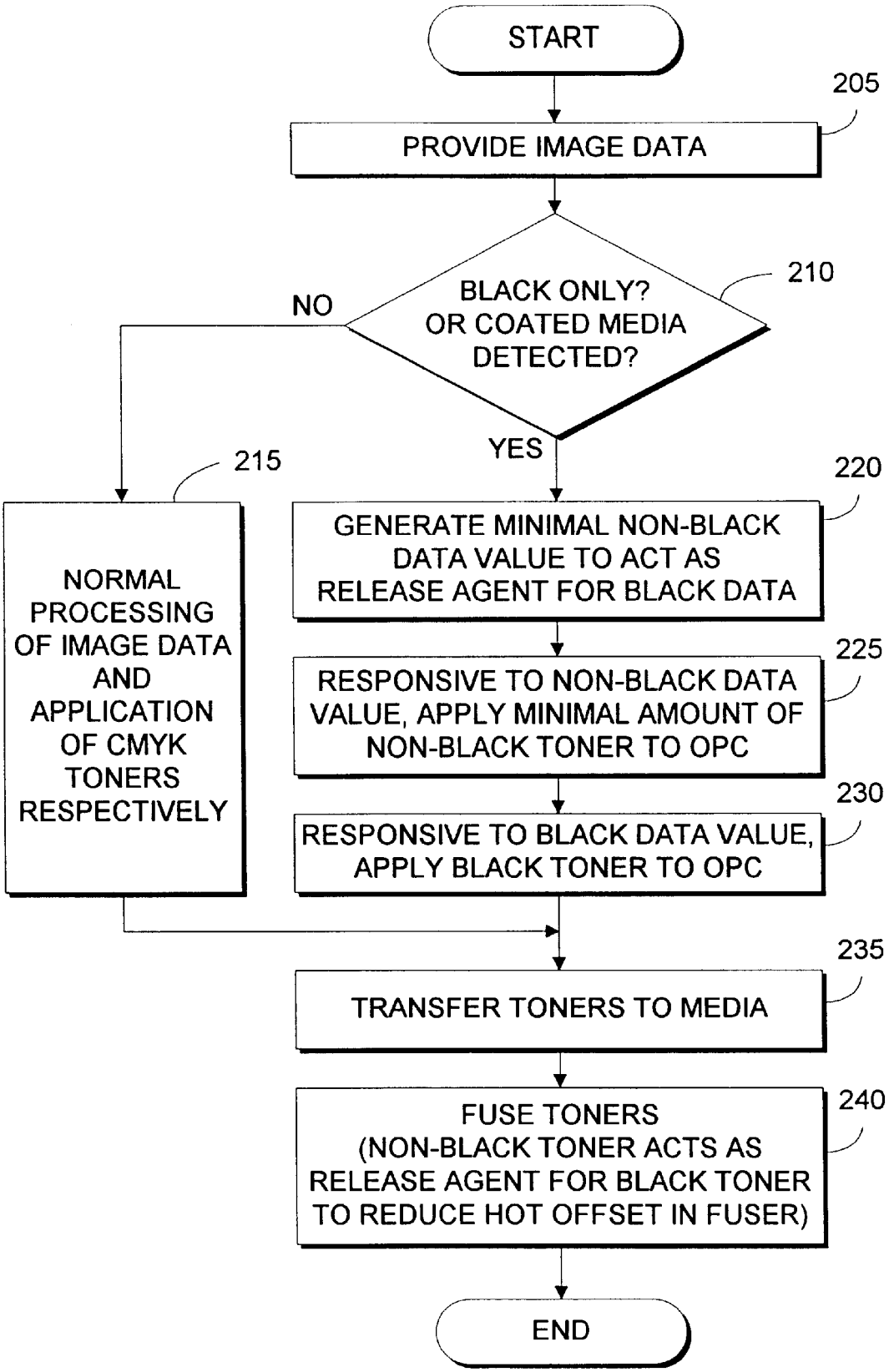
FIG. 8 is a flow chart depicting a preferred method of the present invention.

Referring now to FIG. 8, a flow chart depicts a preferred method of the present invention as controlled in part by the hot offset manager 80 (FIG. 3). First, image data is received from a host 45 and provided 205 to the image processing pipeline of the printer 20 and to the hot offset manager 80. If the image data is not a black only image 210 or if a coated media (such as an OHT) is not detected 210, then normal processing of that image data occurs 215.

On the other hand, if the image data is a black only image 210 or if a coated media (such as an OHT) is detected 210, then a minimal non-black output data value is generated 220 in addition to the black output data value. The non-black data value acts as a release agent data value to reduce or eliminate hot offset of the black toner. For example, in an RGB to CMYK conversion process, if the original provided data values are RGB=0,0,0, meaning a black only image, then the generated output data values may be CMYK=0,0,25,255, representing approximately a 10% value of yellow toner to be applied in addition to a 100% value of black toner. Alternatively, other minimal non-black data values may be generated. For example, CMYK=25,0,0,255, or CMYK=0,50,0,255, or CMYK =10,10,10,255, etc., depending upon system configuration and design parameters. Importantly, however, the non-black toner is applied as a thin layer just sufficient to reduce hot offset of the black toner and such that an appearance of a resultant image formed retains a visual perception of being a black toner only image. In a preferred embodiment, the non-black toner (or total of a combination of non-black toners) is applied at between about five percent (5%) and fifty percent (50%) of the black toner amount.

Subsequently, in response to the minimal non-black data value, the non-black color plane image is created by the laser 70 on the OPC 75 (in a template match of the black color plane image) and then the non-black toner is applied 225 to the OPC 75. Next, in response to the black data value, the black color plane image is created by the laser 70 on the OPC 75 and then the black toner is applied 230 to the OPC 75. Then, both color planes are transferred 235 from the OPC 75 to the media 180 that is currently being imaged by the printer 20. With the transfer to the media, the layer of black toner 185 (FIG. 5) is now closest to the media 180 and the layer of non-black toner 190 is disposed over the layer of black toner. As such, when fusing occurs 240 at the fuser 90, the non-black toner layer 190 acts as a release agent for the black toner layer 185, thereby reducing or eliminating hot offset of the black toner. However, again, in an alternate embodiment the layering of the black toner and non-black toner is not order dependent so long as both are applied to the media, depending upon the imaging and fusing system implementation.

Note that if an intermediate transfer (IT) member (not shown) is utilized in a manner where all four color planes are applied first to the OPC and all four reside on the OPC at one time, and then all four color planes are subsequently transferred to the IT member and then to the media, then the sequence layering process of the present invention is modified slightly. For example, the black toner would be applied to the OPC first with the non-black toner next. This ensures that the non-black toner is transferred first to the IT member and, subsequently, is disposed on top of the black toner when finally transferred to the media to act as the release agent for the black toner.

Figure 9:
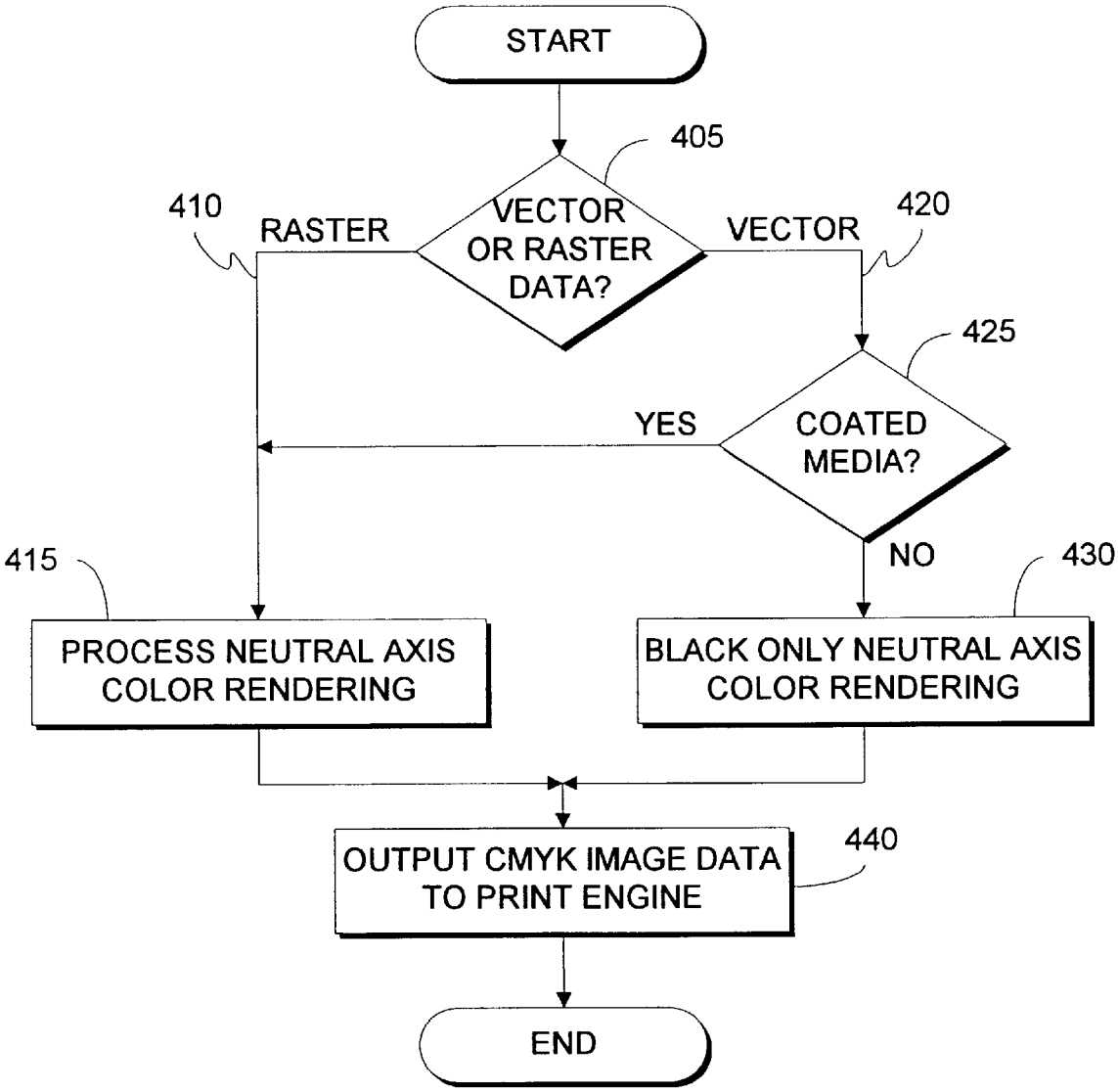
FIG. 9 is a flow chart depicting an alternate method of the present invention.

FIG. 9 is a flow chart depicting an alternate method of the present invention. If source image data in an imaging system is raster data 405, 410, then the data is processed through a process neutral axis color rendering dictionary (table) 415 and subsequently output 440 as CMYK data to the print engine. On the other hand, if source image data in an imaging system is vector data such as text or graphics 405, 420, then the data is generally processed through a black only neutral axis color rendering dictionary (table) 430 and subsequently output 440 as CMYK data to the print engine. However, if it is detected that coated media is being processed 425, then any vector data 420 is redirected 425 to be rendered through the process neutral axis color rendering dictionary 415. This critical step ensures that the potential for hot offset of black toner is avoided when coated media is being image processed.

Finally, what has been described above are preferred embodiments of an apparatus and method for reducing or eliminating hot offset of black toner in an electrophotographic color imaging device. While the present invention has been described by reference to specific embodiments, it will be apparent that other alternative embodiments and methods of implementation or modification may be employed without departing from the true spirit and scope of the invention.

What is claimed is:

1. A method of reducing hot offset in a color electrophotographic imaging device, comprising:

(a) providing data indicative of a black only image for imaging;

(b) responsive to the data, applying black toner on a medium being processed in the imaging device to form the black only image; and, (c) applying a release agent, including a non-black toner, to the medium sufficient to reduce hot offset of the black toner relative to a fusing of the toner onto the medium and such that an appearance of a resultant image formed retains a visual perception of a black only image.

2. The method of claim 1 wherein the release agent includes any combination of a plurality of non-black toners.

3. The method of claim 1 wherein the release agent includes at least one of a cyan, magenta or yellow toner.

4. The method of claim 1 further including, prior to applying the black toner, converting the black only data to data configured to generate the resultant image using the black toner and the release agent.

5. The method of claim 1 wherein the black only data includes gray scale data.

6. The method of claim 1 further including only applying the release agent based upon a condition that a coated medium is to be processed or is being processed by the imaging device.

7. The method of claim 1 wherein the imaging device includes a copier, a printer, or a facsimile device.

8. The method of claim 1 wherein the application of the black toner and release agent is not order specific.

9. A method of imaging in a color electrophotographic imaging device, comprising:

(a) providing data indicative of a black only image for imaging;

(b) responsive to the data, providing control indicia for reducing or eliminating hot offset;

(c) responsive to the data, applying black toner onto a medium being processed in the imaging device to form the black only image; and, (d) responsive to the control indicia, applying a release agent, including a non-black toner, onto the medium in addition to the black toner sufficient to reduce hot offset of the black toner relative to a fusing of the toner onto the medium and such that an appearance of a resultant image formed retains a visual perception of a black only image.

10. The method of claim 9 wherein the release agent includes any combination of a plurality of non-black toners.

11. The method of claim 9 further including only applying the release agent based upon a further condition that a coated medium is to be processed or is being processed by the imaging device.

12. The method of claim 9 wherein the control indicia includes data provided by a color conversion table.

13. The method of claim 9 wherein the imaging device includes a copier, a printer, or a facsimile device.

14. An imaging device, comprising:

(a) a color electrophotographic imaging engine;

(b) a processor configured to provide data indicative of a black only image; and, (c) control indicia configured to coordinate with the data and in combination control the imaging engine such that: (i) black toner is applied onto a medium being processed in the imaging device to form the black only image, and (ii) a release agent, including a non-black toner, is applied onto the medium in addition to the black toner sufficient to reduce hot offset of the black toner relative to a fusing of the toner onto the medium and such that an appearance of a resultant image formed retains a visual perception of a black only image.

15. The imaging device of claim 14 wherein the release agent includes any combination of a plurality of non-black toners.

16. The imaging device of claim 14 wherein the control indicia includes data provided by a color conversion table.

17. The imaging device of claim 14 further including control apparatus configured to enable the application of the release agent based upon a further condition that a coated medium is to be processed or is being processed by the imaging device.

18. The imaging device of claim 14 wherein the imaging device includes a copier, a printer, or a facsimile device.

19. A computer readable medium having computer-executable instructions configured to perform steps including:

(a) providing data indicative of a black only image for imaging;

(b) responsive to the data, applying black toner on a medium being processed in an imaging device to form the black only image; and, (c) applying a release agent, including a non-black toner, to the medium being processed sufficient to reduce hot offset of the black toner relative to a fusing of the toner onto the medium being processed and such that an appearance of a resultant image formed retains a visual perception of a black only image.

* * * * *